US007757423B1

(12) United States Patent
Swan

(10) Patent No.: US 7,757,423 B1
(45) Date of Patent: Jul. 20, 2010

(54) MOUNTING ASSEMBLY WITH ADJUSTABLE SPRING TENSION

(76) Inventor: Richard E. Swan, 171 West St., E. Bridgewater, MA (US) 02333

( * ) Notice: Subject to any disclaimer, the term of this patent is extended or adjusted under 35 U.S.C. 154(b) by 208 days.

(21) Appl. No.: 11/933,506

(22) Filed: Nov. 1, 2007

Related U.S. Application Data

(60) Provisional application No. 60/864,022, filed on Nov. 2, 2006.

(51) Int. Cl.
*F41G 1/38* (2006.01)

(52) U.S. Cl. ..... 42/127; 42/124; 42/125; 403/374.5

(58) Field of Classification Search ..... 42/72, 42/90, 124–128; 403/373, 374.1, 374.2, 403/374.5
See application file for complete search history.

(56) References Cited

U.S. PATENT DOCUMENTS

| | | | | |
|---|---|---|---|---|
| 1,428,655 | A | 9/1922 | Noske | |
| 2,101,037 | A * | 12/1937 | O'Neil | 42/126 |
| 2,161,051 | A | 6/1939 | Humeston | |
| 3,877,166 | A | 4/1975 | Ward | |
| 4,845,871 | A | 7/1989 | Swan | |
| 4,860,480 | A | 8/1989 | Ruger | |
| 4,905,396 | A | 3/1990 | Bechtel | |
| 5,155,915 | A | 10/1992 | Repa | |
| 5,276,988 | A | 1/1994 | Swan | |
| 5,606,818 | A | 3/1997 | Hardee | |
| 5,653,034 | A * | 8/1997 | Bindon | 42/131 |
| 5,669,173 | A | 9/1997 | Rodney, Jr. | |
| 5,680,725 | A | 10/1997 | Bell | |
| 6,295,754 | B1 | 10/2001 | Otterman et al. | |
| 6,442,883 | B1 | 9/2002 | Waterman et al. | |
| 6,449,893 | B2 | 9/2002 | Spinner | |
| 6,490,822 | B1 | 12/2002 | Swan | |
| 6,513,276 | B2 | 2/2003 | Mendoza-Orozco | |
| 6,598,333 | B1 | 7/2003 | Randazzo et al. | |
| 6,622,415 | B1 * | 9/2003 | Canaday et al. | 42/140 |
| 6,922,934 | B1 | 8/2005 | Huan | |
| 6,931,778 | B1 | 8/2005 | Nelson et al. | |

(Continued)

OTHER PUBLICATIONS

TM 9-4931-710-14&P, Technical Manual, Operator, Organizational, Direct Support and General Support Maintenance Manual, Headquarters, Department of the Army. Aug. 1986.

*Primary Examiner*—J. W Eldred
*Assistant Examiner*—Gabriel J Klein
(74) *Attorney, Agent, or Firm*—Barlow, Josephs & Holmes, Ltd.

(57) ABSTRACT

An improved mounting assembly is provided that is configured to be releasably attached to a standard dovetail rail profile, wherein the initial clamping tension of the clamping actuator is adjustable. The mounting assembly generally includes a main body having a lower portion that is configured to engage a standard dovetail and an upper portion accessory receiving formation. The lower portion of the mounting assembly has a first engagement member extending downwardly along one side thereof for engaging one side of the dovetail rail and a clamping assembly to engage the opposing side of the dovetail rail. At least one spring and a retention nut are provided as part of the clamping assembly such that retention nut controls the preset spring tension thereby controlling the clamping force applied by the clamping assembly.

4 Claims, 6 Drawing Sheets

U.S. PATENT DOCUMENTS

| | | | | |
|---|---|---|---|---|
| 7,272,904 | B2 | 9/2007 | Larue | |
| 2004/0148842 | A1 | 8/2004 | Aalto et al. | |
| 2006/0123686 | A1 | 6/2006 | Larue | |
| 2006/0207156 | A1 | 9/2006 | Larue | |
| 2008/0092425 | A1 * | 4/2008 | Keng | 42/145 |

* cited by examiner

MOUNTING ASSEMBLY WITH ADJUSTABLE SPRING TENSION

CROSS-REFERENCE TO RELATED APPLICATIONS

This application is related to and claims priority from earlier filed U.S. Provisional Patent Application No. 60/864,022, filed Nov. 2, 2006.

BACKGROUND OF THE INVENTION

The present invention relates generally to modular integrated accessory mounting assemblies for combat weapons. More specifically, the present invention relates to an accessory mounting assembly, which includes an actuator that is incorporated into the accessory mount in a manner that provides adjustable spring tension to control the clamping force exerted by the actuator against the firearm interface rail.

As the field of combat and commercial weaponry expands, numerous add-on enhancements have become available for attachment to standard firearms, thereby significantly upgrading the capability of the firearm. Of particular interest in the area of combat weapons is the well-known M16/M4 weapon system (M16 and M4 are trademarks of Colt Defense, Inc.). The M16 has been in service for a number of years and will continue to be a popular rifle both in U.S. and foreign militaries for the foreseeable future. Generally, the M16/M4 weapon 2, as depicted in FIG. 1, includes a lower receiver 4, upper receiver 6, butt stock 8, and barrel 10.

The newer models of the M16/M4 weapons further include a mil-std 1913 dovetail rail 12 extending along the top of the upper receiver. This integrated receiver rail 12 provides a convenient mounting point for many types of enhancement devices such as scopes and other sighting devices. However, space on the upper receiver rail 12 is limited, and many military personnel often have multiple sighting devices that are each tailored to perform in different combat situations. In addition, there are a variety of lighting devices, handgrips, etc. that could also be attached to the weapon for enhanced use of the weapon. The difficulty is that there is simply not enough space on the integrated rail provided on the upper receiver to accommodate all of the desired accessories. Accordingly, the increasing development and refinement of laser sights, infrared lighting, visible lighting, night vision, and specialized scopes and magnifiers, and other accessories continues to drive the need for versatile and reliable integration systems that include additional mil-std 1913 dovetail rails positioned above or around the barrel of the weapon that can support this important equipment and yet stand the test of rugged military use and abuse.

Responding to this need, the applicant has developed a modular integrated rail system (A.R.M.S.® S.I.R.® system) shown at FIG. 2, which has been well received by the military and has become popular with several branches of the military. The A.R.M.S. S.I.R. system is fully described in U.S. Pat. No. 6,490,822, the entire contents of which are incorporated herein by reference. These modular integrated rail systems for combat weapons 2 generally include an upper hand guard 14, a means 16 for securing the upper hand guard 14 to the weapon 2, a lower firearm accessory 18 (in most cases this is a lower hand guard), various optional rail segments, and in many cases, a sling swivel 20 for attaching a shoulder sling to carry the weapon 2.

The upper hand guard 14 is the main structural element of the system. The upper hand guard is 14 generally semi-cylindrical in shape and has a forward end and a rearward end and a mil-std 1913 dovetail rail 22 extending longitudinally between the forward end and the rearward end. The semi-cylindrical upper hand guard 14 further includes symmetrically opposing side walls that extend outwardly and downwardly from the dovetail rail and terminate in symmetrically opposing longitudinally extending mounting channels. The mounting channels are used to mount various accessories, such as a lower hand guard 18 or a grenade launcher, to the upper hand guard 14.

An interface means 16 is provided at the rearward end of the upper hand guard 14 to removably secure the upper hand guard 14 to the firearm 2. In the original S.I.R. system as shown in U.S. Pat. No. 6,490,822, the interface includes elongated sleeve that secures the upper hand guard 14 to the dovetail rail 12 on the top of the upper receiver 6 of the weapon 2 as well as a U-shaped yoke or clamp (not shown) that secured the upper hand guard 14 to the barrel nut of the weapon. In the other S.I.R. systems, the interface means 16 is a larger U-shaped yoke or clamp that secures the upper hand guard 14 exclusively to the barrel nut with the upper rail 22 sitting flush with the receiver rail 12.

As is well known in this area, field modification of weapon configurations is critical in combat situations. For example, it may be desired to swap the lower hand guard for a grenade launcher, which can be attached to the upper hand guard, or to add an optional rail segment for securing an added accessory. Similarly, there may be a desire to exchange various different sights or lighting accessories that are mounted on the various dovetail rails positioned around the weapon. In this regard standardized attachment assemblies have been developed to allow quick and easy removal and mounting of these devices relative to the dovetail rails.

Such an attachment device is disclosed in U.S. Pat. No. 5,276,988, issued on Jan. 11, 1994 to the present applicant, the contents of the '988 patent being incorporated herein by reference. Generally, the prior art attachment assemblies as shown at FIGS. 3A and 3B include a main body 24 having a lower portion that is configured to engage the dovetail rail 22 found on most modern combat weapons 2 and an upper portion 26 that can take on a variety of configurations depending on the accessory that is to be mounted thereon. The lower portion of the mounting assembly has a first engagement member 28 extending downwardly along one side thereof for engaging one side of the dovetail rail 22. Further, a boss formation 30 is provided adjacent the side of the main body to receive a clamping assembly 32 that is particularly suited to be releasably engaged with a second side of the dovetail rail 22 such that the clamping assembly cooperates with the first engagement member 28 to retain the modular mounting assembly in its installed position on the dovetail rail. The clamping assembly 32 generally includes a foot portion 32A with a cam surface 32B to engage the angulated surface of the dovetail rail 22, a post (not shown) extending upwardly through the boss formation 30 and a head portion 32C secured to the top end of the post and having actuator arm 32D to facilitate rotation of the foot portion 32A. The clamping assembly 32 further includes spring washers (not shown), which are captured between the bottom surface of the head portion 32C and the boss 30 (or a bushing within the boss) to provide a self-adjusting amount of spring tension as the clamping assembly 32 is rotated into engagement with the rail 22. These springs generally allow a limited, self-adjusted amount of biased vertical movement of the clamping foot 32A relative to the boss and the rail 22. Because the head portion 32C of the clamping assembly 32 is secured in a fixed position on the top end of the post, the spring are compressed by a fixed amount and therefore the force exerted by the foot 32A on the rail 22 was generally variable, but variable only within a certain range as determined by the initial spring tension. This small range of self-adjustment is critical in being able to accommodate the small dimensional variations in the dovetail rails of various equipment manufacturers.

Further, when such devices are employed with sighting accessories it is critical that the alignment of the device be repeatable and reliable after several removal and reinstallation cycles. If the camming force is too loose, the sight cannot be reinstalled with a high degree of accuracy. Similarly, if the camming force is too great, rotation of the cam foot can damage the rail.

Finally, despite the benefits of a fixed, self-adjusting range of spring tension provided by the prior art device, in certain environments, there is still a perceived need to adjust the range of the spring tension, for example if rails have excessive wear there may be a need to slightly increase the initial spring tension. However, there is also a desire to prevent the user of the weapon from being able to adjust the tension without some type of restriction. Tighter is not better in these circumstances and overtightening can lead to damage to the rail of the weapon. Accordingly, while a need for adjustment may be accommodated, it must be provided in a manner that accommodates all of the environmental variables while still allowing the accessory mount to be ruggedly attached to the rail, but still preventing a wholesale ability to crank the spring tension to a maximum force which would damage the rail of the weapon. There is thus a struggle between the benefits of a fixed mounting of the head portion 32C so as to provide a fixed, self-adjusting range of spring tension, and the perceived need to be able to adjust the range of the spring tension.

Accordingly, there is a perceived need for a modular mounting assembly that allows for the releasable mounting of various accessories onto the standard dovetail rail found on modern combat weapons and that can be reliably mounted onto a dovetail rail while including an actuator that includes the ability to adjust the spring tension that is exerted by the clamping foot.

BRIEF SUMMARY OF THE INVENTION

In this regard, the present invention provides for an improved mounting assembly that is configured to be releasably attached to a standard dovetail rail profile wherein the initial clamping tension of the clamping assembly is adjustable.

The mounting assembly of the present invention generally includes a main body having a lower portion that is configured to engage the dovetail rail found on most modern combat weapons as depicted in FIG. 1 and an upper portion that can take a variety of configurations depending on the accessory that is to be mounted thereon. A boss formation including an opening extends outwardly to the side of the main body. A bushing including a central opening is mounted within the opening of the boss formation. The lower portion of the main body has a first engagement member extending downwardly along one side thereof for engaging one side of the dovetail rail.

In the scope of the present invention, an improved clamping assembly comprises a foot portion position adjacent the bottom surface of the boss formation and an actuator arm extending from the foot portion. The foot portion includes a cam surface similar to the prior art foot portion. A shaft affixed to the foot portion extends upwardly through the opening in the bushing. At least one spring (Belleville) washer is received around the shaft adjacent the upper surface of the bushing, and a retention nut is threaded onto the upper end of the shaft such that the spring is captured between the bottom surface of the retention nut and the upper surface of the bushing. The spring washer is compressed as the retention nut is tightened thereby providing for adjustment of the initial spring tension of the clamping assembly.

To insure that the retention nut remains in the position set by the user, actuator arm includes a spring-biased indexing pin that engages indexing formations on the outer surface of the retention nut. The indexing formations correspond to different levels of preset tension, i.e. tight, medium and loose. It is this adjustment in the initial spring tension that directly translates to the amount of force with which the clamping assembly engages the rail. Should the user wish to adjust the spring tension, the retention nut is turned until the desired spring tension is achieved. The retention nut also includes mechanical stop that prevents over tightening as well as a shoulder that prevents loosening of the nut once installed.

Accordingly, it is an object of the present invention to provide an improved mounting assembly that allows for the releasable mounting of various accessories onto the standard dovetail rail found on modern combat weapons. Further, it is an object of the present invention to provide a mounting assembly that can be reliably mounted onto a dovetail rail while including an actuator that includes the ability to adjust the spring tension that is exerted by the clamping foot. It is still a further object of the present invention to provide a mounting assembly having an adjustable actuator that further includes indexed presets that allow a user to predictably and reliably control the spring tension and clamping force of the mounting assembly while also preventing accidental over tightening thereof.

These, together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
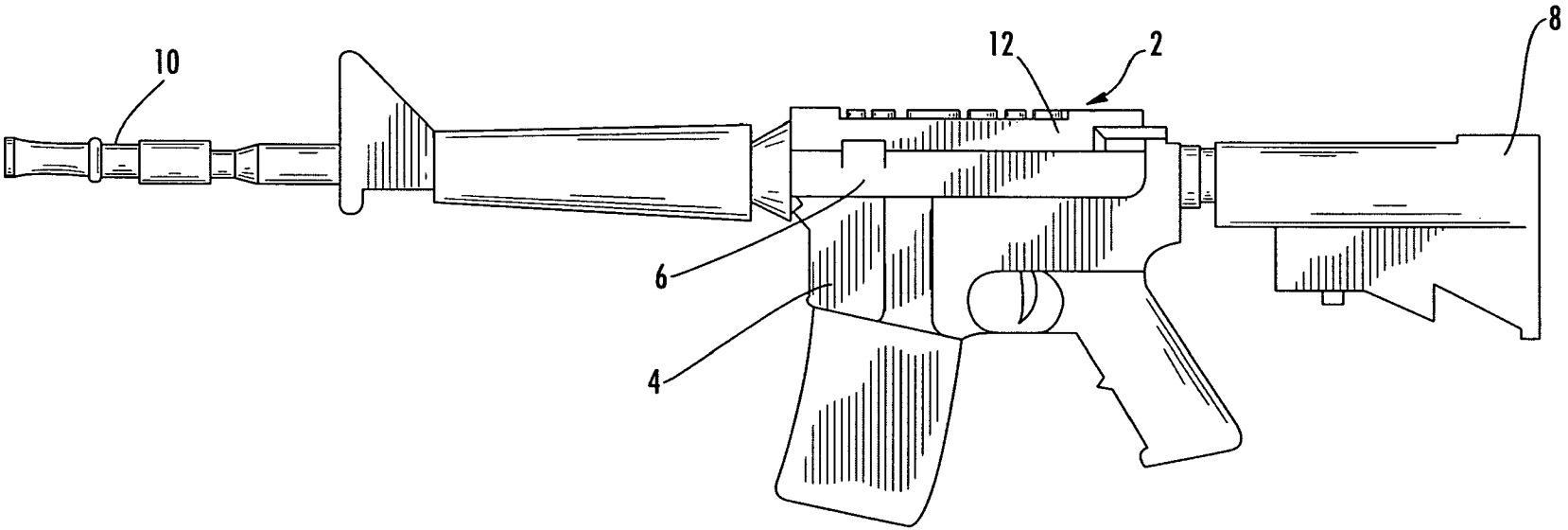
FIG. 1 (PRIOR ART)
FIG. 1 is a side view of a prior art combat firearm.
Figure 4:
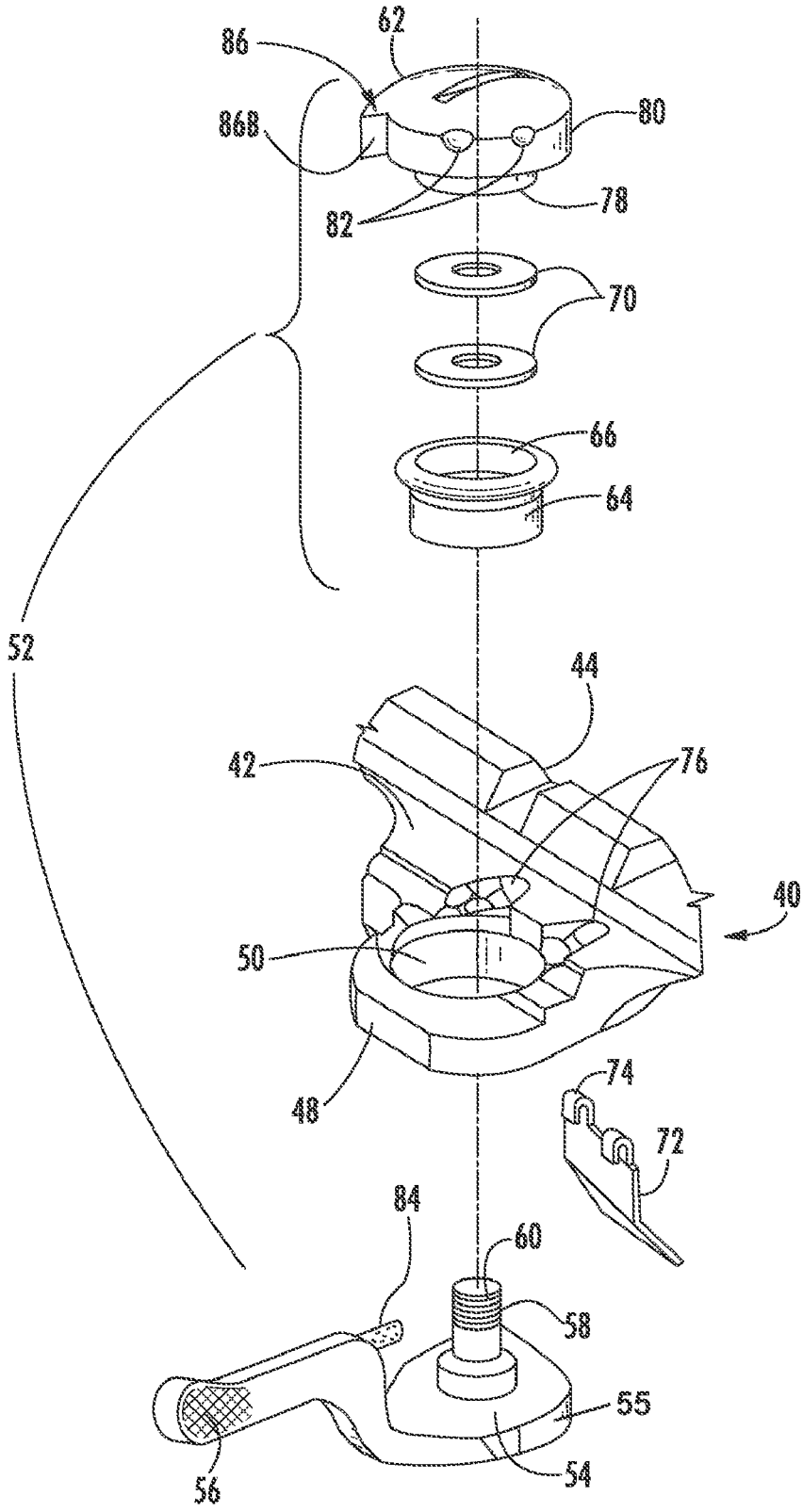
FIG. 4 is an exploded perspective view of the mounting assembly of the present invention.
Figure 5:
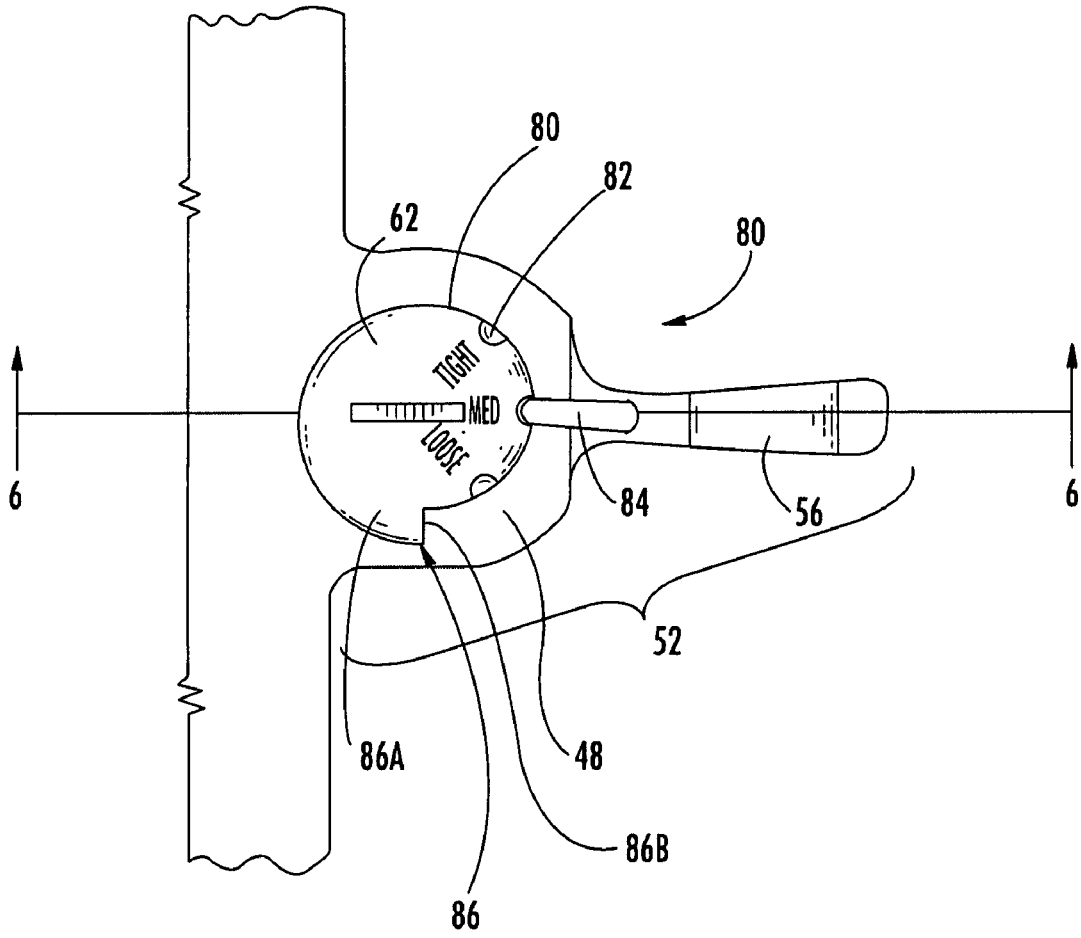
FIG. 5 is a top view of the mounting assembly of the present invention.
Figure 6:
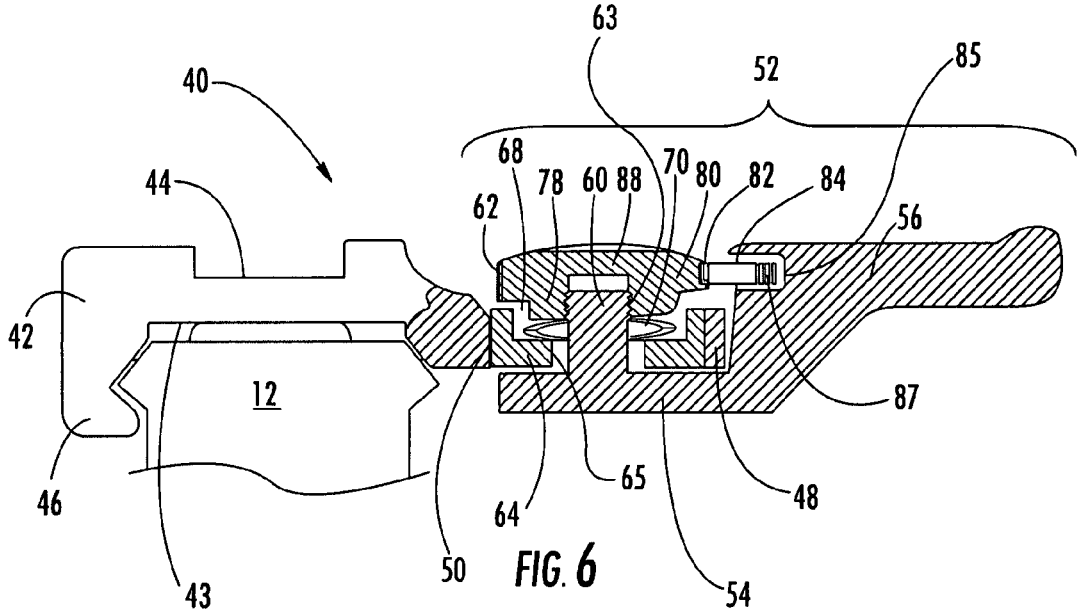
FIG. 6 is a partial cross-sectional view taken along line 6-6 of FIG. 5.

Now referring to the drawings, the mounting assembly is shown and generally illustrated at 40 in FIGS. 4-6. The mounting assembly 40 is configured to be releasably attached to a standard dovetail rail profile 12 as is depicted in FIG. 1, and includes a means for adjustment to control the clamping force exerted by the mounting assembly 40 against the dovetail rail 12, as will be discussed in more detail below. The mounting assembly 40 of the present invention is particularly suited for use in connection with any firearm 2 that utilizes a standard dovetail rail 12 or a supplemental rail system.

Turning now to FIG. 4, as can be seen, the mounting assembly 40 includes a main body 42 that is configured in substantially the same manner as a traditional prior art device and further includes a lower portion 43 that is configured to engage the dovetail rail 12 found on most modern combat weapons 2 and an upper portion 44 that can take on a variety of configurations depending on the accessory that is to be mounted thereon. As can best be seen in FIG. 6, the lower portion 43 of the main body 42 has a first engagement member 46 extending downwardly along one side thereof for engaging one side of the dovetail rail 12. Opposite the first engagement member 46, a boss formation 48 is provided adjacent the side of the main body 42 wherein the boss formation 48 includes a large central opening 50 therein to receive a clamping assembly generally indicated at 52. An annular bushing 64 with a smaller central opening 65 is installed into the large central opening 50.

Figure 2:
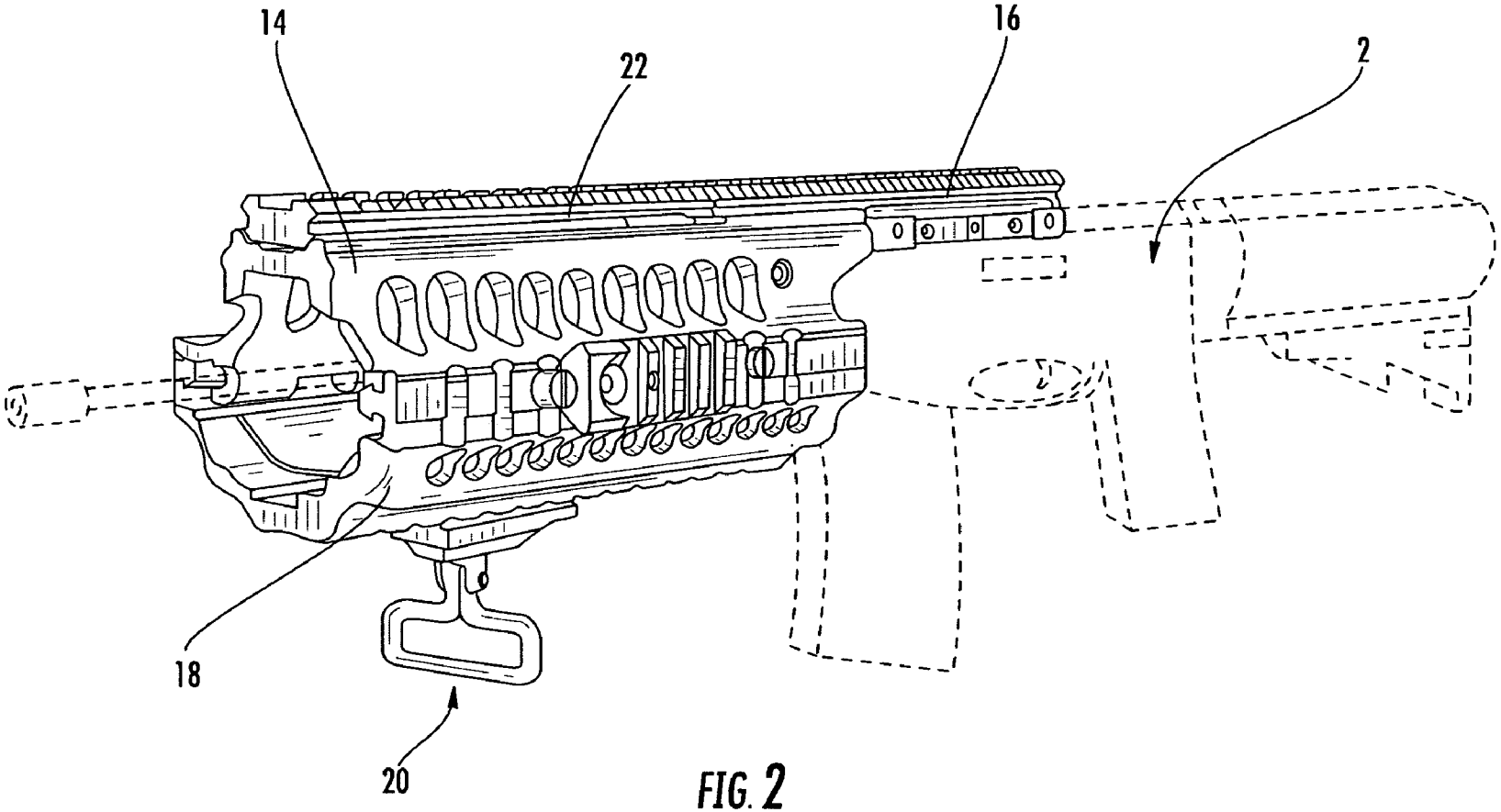
FIG. 2 (PRIOR ART)
FIG. 2 is a perspective view of a prior art rail interface system.
Figure 3A:
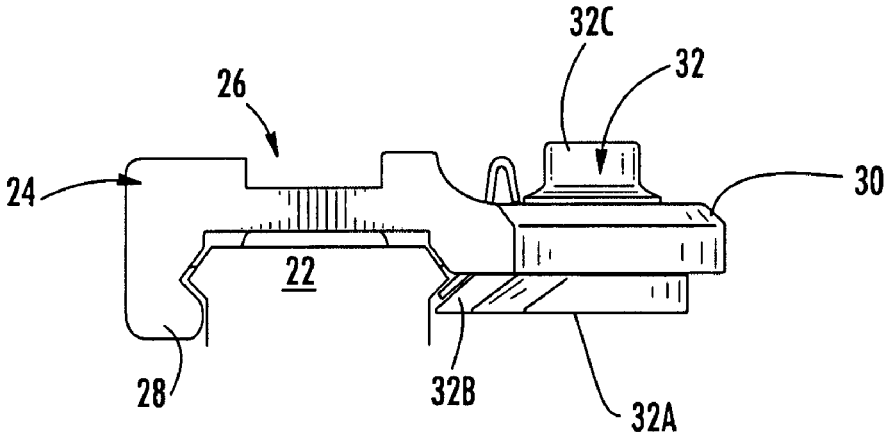
FIG. 3A (PRIOR ART)
FIG. 3A is an end view of a prior art mounting assembly in the engaged position.
Figure 3B:
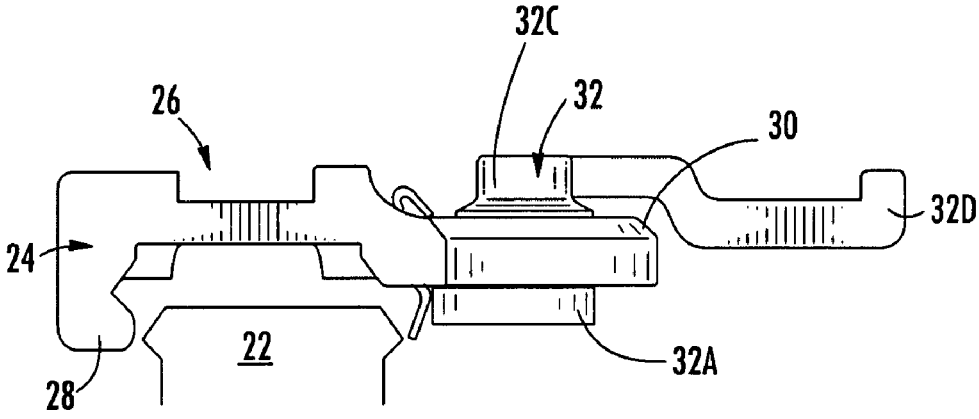
FIG. 3B (PRIOR ART)
FIG. 3B is an end view of a prior art mounting assembly in the disengaged position.

Turning back now to FIG. 4, in the scope of the present invention, the clamping assembly 52 replaces the clamping assembly of the prior art as is depicted in FIGS. 2 and 2*a*. In the present invention, the clamping assembly 52 is configured to releasably engage a dovetail rail interface 12 with a self-adjusting clamping force that has an adjustable range of spring tension. The clamping assembly 52 and the first engagement member 46 cooperate to hold the main body 42 on the dovetail rail 12.

The clamping assembly 52 is received into and supported by the boss formation 48 that extends outwardly from the side of the body 42 of the mounting assembly 40. The clamping assembly 52 generally includes a foot portion 54 that is positioned adjacent the bottom surface of the boss 48 formation. The foot portion 54 includes an angulated cam surface 55 that extends around the side surface of the foot portion 54 as in the prior art devices. However, in contrast to the prior art as described, the actuator arm 56 extends outwardly directly from the foot portion 54 below the boss formation 48 rather then being attached to the foot above the boss formation. The actuator arm 56 allows the user to rotate the foot portion 54 thereby selectively rotating the foot portion 54 between engaged and disengaged positions. A shaft 58 is affixed to and extends upwardly from the foot portion 54 through the smaller opening 65 in the bushing 64 and terminates in a threaded end 60.

At least one spring washer 70 is received around the shaft 58 and is seated on an upper surface of the bottom wall 66 of the bushing 64 within a central recess 68. The spring washer 70 is preferably a Belleville spring although any other suitable disc-type springs would also fall within the scope of the invention. Further, a plurality of spring washers 70 may be utilized in series, in parallel or in a combination thereof in order to achieve the desired spring tension and deflection properties.

A retention nut 62 having a threaded bore 63 is threadedly received on the threaded terminal end 60 of the shaft 58 such the spring washer 70 is captured between the bottom surface of the retention nut and the upper surface of the bottom wall 66 of the bushing 64. The spring washer(s) 70 is/are compressed as the retention nut 62 is tightened thereby providing for adjustment of the initial spring tension of the clamping assembly 52.

There is also shown a steel buffer pad 72 having a flat horizontal base portion with an arm 74 at each end of the base extending upwardly at an oblique angle of 135 degrees. The free end of each arm 74 is curved approximately 150 degrees. Two side-by-side openings 76, corresponding in separation to the separation between buffer pad arms 74, are formed in the main body 42. The arms 74 of the buffer pad 72 are slid through the openings 76. In operation, the buffer element 72 sits between the angulated surface of the rail 12 and the cam surface 55 of the foot portion 54. Rotation of the actuator arm 56 causes the foot portion 54 to press the buffer element 72 into the side of the firearm rail 12. The buffer element 72 prevents the foot portion 54 from directly touching and thereby marring the outer surface of the firearm rail 12. Rotation of the actuator arm 56 and the consequent movement of the foot portion 54 against the buffer element 72 overcomes the resistance of the spring washers 70 and moves the buffer element 72 against the engagement surface of the rail interface 12.

To insure that the retention nut 62 remains in a position as set by the user, the clamping assembly 52 further comprises an indexing means for positively indexing the position of the retention nut 62 on the threaded shaft 58. The indexing means preferably comprises at least one indexing formation (detent) 82 on the outer edge surface 80 of the retention nut 62 and a spring-biased indexing pin 84. The indexing pin 84 is received within a bore 85 formed in the handle portion of the actuator arm 56. A small spring 87 is captured between the inner end of the indexing pin 84 and the inner end of the bore 85 to bias the pin 84 outwardly towards the retention nut 62.

Preferably the retention nut 62 includes a plurality of indexing formations 82. Even more preferably, the retention nut 62 includes three indexing formations 82 corresponding to three levels of preset tension, i.e. tight, medium and loose.

Since the spring washer(s) 70 are trapped between the retention nut 62 and the bushing 64, tightening of the retention nut 62 causes compression of the spring washers 70, shortens the range of the vertical travel of the foot portion 54 relative to the bottom surface of the boss and increases the spring clamping force. Accordingly, when the actuator arm 56 rotates the foot portion 54 into engagement with the rail 12, additional spring pressure is exerted on dovetail rail 12. Similarly, as the retention nut 62 is loosened, the compression of the disc springs 70 is reduced, the range of vertical travel of the foot portion 54 is increased, and the clamping force is reduced.

It is this adjustment in the initial spring tension that directly translates to the amount of force with which the clamping assembly 52 engages the rail 12. Should the user wish to adjust the spring tension, the spring-loaded pin 84 is either depressed, or withdrawn in a manner that allows rotation of the retention nut 62, and the retention nut 62 is then turned until the desired spring tension is achieved. The pin 84 is then released and it again engages one of the indexing formations 82 in the surface of the retention nut 62 preventing inadvertent rotation thereof.

In order to prevent removal of the retention nut 62 once installed, the edge of the retention nut 62 include a stop shoulder 86 with a ramped surface 86A on one side and a flat edge 86B on the other. The ramped surface 86A is arranged so that as the retention nut 62 is tightened the pin 84 rides up and over the ramp surface 86A. However, the flat edge 86B of the shoulder 86 prevents inadvertent or accidental loosening (counterclockwise rotation) of the retention nut 62.

Further, to prevent over-tightening of the retention nut 62, the threaded bore 63 contains a positive mechanical stop. Preferably, the threaded bore 63 does not extend all the way through the retention nut 62 and includes and end wall 88 or a reduced diameter area that prevents over tightening of the retention nut 62. In this regard, the retention nut 62 can be installed until it bottoms out on the shaft 58 and thereafter can be backed off to one of the three predetermined settings corresponding to the indexing formations 82.

Accordingly, it can be seen that the present invention provides a unique and novel modular accessory mount that fills a critical need for soldiers in the field by ensuring positive and reliable operation. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A mounting assembly for attaching an accessory to a dovetail rail interface on a firearm, said mounting assembly comprising:

a body having a lower portion and an upper portion, said lower portion configured to engage a first side of said dovetail rail, said upper portion configured to receive and retain said accessory;

a boss formation extending outwardly from a side of said body and including an opening therein;

a clamping assembly configured to releasably engage a second side of said dovetail rail, including, a foot portion positioned adjacent a bottom surface of said boss formation, said foot portion including a cam surface;

an actuator arm extending outwardly from said foot portion;

a shaft extending upwardly through said opening in said boss formation, a terminal end of said shaft being threaded;

a spring received around said shaft adjacent the top surface of said boss formation;

a cap nut threadedly received on said terminal end of said shaft such that said spring is captured between a bottom surface of said cap nut and a top surface of said boss formation, and further such that rotation of said cap nut adjusts the initial compression of said spring, said cap nut having a plurality of indexing formations on a side surface thereof;

a spring biased indexing pin slidably received in a bore in said actuator arm adjacent said cap nut, said indexing pin being configured and arranged to engage said indexing formations on said side surface of said cap nut and thereby positively index and maintain a position of said cap nut on said threaded shaft said cap nut further having a stop shoulder having a ramped surface configured and arranged for sliding engagement with said indexing pin when said cap nut is rotated in a clockwise direction and further having a flat edge configured and arranged for locking engagement with said indexing pin when said cap nut is rotated in a counterclockwise direction; and a buffer pad pivotally attached adjacent a bottom surface of said lower portion and adjacent said clamping assembly, wherein movement of said clamping assembly to releasably engage said dovetail rail causes said foot portion to clamp said buffer pad against said second side of said dovetail rail.

2. The mounting assembly of claim 1, wherein said clamping assembly further comprises a bushing received within said opening in said boss formation, said bushing including an opening, said shaft of said clamping assembly extending through said opening in said bushing, said spring washer being captured between the bottom surface of said retention nut and a top surface of said bushing.

3. The mounting assembly of claim 1 wherein each of said indexing formations has a respective marking associated therewith on a top surface of said cap nut, said marking being configured to inform the user of a preset index position.

4. The mounting assembly of claim 3 wherein said boss formation includes a shoulder formation configured and arranged to prevent rotation of said actuator arm beyond a disengaged position.

* * * * *